United States Patent [19]

Sakamari et al.

[11] Patent Number: 5,022,842

[45] Date of Patent: Jun. 11, 1991

[54] VANE PUMP WITH ROTATABLE ANNULAR RING MEANS TO CONTROL VANE EXTENSION

[75] Inventors: Hiroshi Sakamari; Yukio Horikoshi; Takeshi Jinnouchi; Kenji Tanzawa, all of Sakado, Japan

[73] Assignee: Eagle Industry Co., Ltd., Tokyo, Japan

[21] Appl. No.: 508,743

[22] Filed: Apr. 12, 1990

Related U.S. Application Data

[60] Division of Ser. No. 197,548, May 23, 1988, Pat. No. 4,958,995, which is a continuation-in-part of Ser. No. 75,006, Jul. 17, 1987, abandoned, Ser. No. 110,919, Oct. 21, 1987, abandoned, Ser. No. 113,568, Oct. 26, 1987, abandoned, and Ser. No. 115,677, Oct. 30, 1987, abandoned.

[30] Foreign Application Priority Data

| | | | |
|---|---|---|---|
| Jul. 22, 1986 | [JP] | Japan | 61-111490[U] |
| Jul. 22, 1986 | [JP] | Japan | 61-170903 |
| Oct. 23, 1986 | [JP] | Japan | 61-161609[U] |
| Oct. 23, 1986 | [JP] | Japan | 61-161610[U] |
| Nov. 4, 1986 | [JP] | Japan | 61-168145[U] |
| Nov. 4, 1986 | [JP] | Japan | 61-168147[U] |
| Nov. 14, 1986 | [JP] | Japan | 61-269960[U] |
| Nov. 17, 1986 | [JP] | Japan | 61-271934 |
| Nov. 21, 1986 | [JP] | Japan | 61-178287[U] |
| Nov. 21, 1986 | [JP] | Japan | 61-178288[U] |
| Nov. 21, 1986 | [JP] | Japan | 61-276689 |
| Nov. 21, 1986 | [JP] | Japan | 61-276690 |
| Dec. 3, 1986 | [JP] | Japan | 61-185571[U] |
| Nov. 14, 1988 | [JP] | Japan | 61-269961 |

[51] Int. Cl.[5] ..... F04C 2/344

[52] U.S. Cl. ..... 418/257; 418/265

[58] Field of Search ..... 418/256, 257, 260, 261, 418/264, 265

[56] References Cited

U.S. PATENT DOCUMENTS

| | | | |
|---|---|---|---|
| 1,316,885 | 9/1919 | Olson | 418/265 |
| 2,672,282 | 3/1954 | Novas | 418/264 |

FOREIGN PATENT DOCUMENTS

| | | | |
|---|---|---|---|
| 410753 | 5/1934 | United Kingdom | 418/265 |

*Primary Examiner*—John J. Vrablik

*Attorney, Agent, or Firm*—Jordan and Hamburg

[57] ABSTRACT

A vane pump in which a projection is provided on the end of a vane which radially slides as a rotor rotates, and an annular race concentric with an inner peripheral surface of a housing is provided in the inner surface of the end wall of the housing, the projection being brought into engagement with the annular race to control the slide of the vane.

3 Claims, 3 Drawing Sheets

VANE PUMP WITH ROTATABLE ANNULAR RING MEANS TO CONTROL VANE EXTENSION

RELATED APPLICATIONS

This is a division application of U.S. Ser. Nos. 197,548, filed May 23, 1988, 4,958,995, which is a continuation-in-part application of 075,006 filed Jul. 17, 1987, abandoned; 110,919 filed Oct. 21, 1987, abandoned; 113,568 filed Oct. 26, 1987, abandoned; and 115,677 filed Oct. 30, 1987abandoned.

BACKGROUND OF THE INVENTION

The present invention relates to a vane pump which is one of rotary pumps used for various kinds of apparatuses such as a supercharger of an engine, a compressor of a freezing cycle, and the like.

A vane pump schematically shown in FIG. 4 has been heretofore widely known.

In FIG. 4, reference numeral 101 designates a housing; 102, a rotor inserted eccentrically into an inner peripheral space of the housing 101 and rotatably supported by a rotational shaft 103; 105*a*, 105*b* and 105*c*, plate-like vanes disposed radially retractably from vane grooves 104*a*, 104*b* and 104*c* equally spaced apart so as to peripherally divide the outer peripheral side of the rotor 102 into three sections. When the rotor 102 is rotated in the direction as indicated by the arrow X by the rotational shaft 103, the vanes 105*a*, 105*b* and 105*c* are moved out in the direction of the outside diameter by the centrifugal force, and the end edges thereof rotate while slidably contacting the inner peripheral surface of the housing 101. Since the rotor 102 is eccentric with respect to the housing 101 as previously mentioned, as such rotation occurs, volumes of working spaces 106*a*, 106*b* and 106*c* defined by the housing 101, the rotor 102 and the vanes 105*a*, 105*b* and 105*c* are repeatedly enlarged and contracted to allow a fluid taken in form an intake port 107 to be discharged out of an outlet port 108.

However, the above-described conventional vane pump has problems that since the vanes slidably move along the inner peripheral surface of the housing at high speeds, the efficiency of the volume caused by the great power loss due to the sliding resistance and by the generation of high sliding heat unavoidably deteriorates; the vanes materially become worn; and the vanes are expanded due to the generation of sliding heat to produce a galling with the inner side surfaces of both end walls of the housing, and the like.

In view of these problems as noted above, it is an object of the present invention to enhance the efficiency of such a pump and enhance the durability thereof.

SUMMARY OF THE INVENTION

To achieve the aforementioned objects, a vane pump according to the present invention is characterized in that projections such as pins are provided on both ends of a vane, and an annular race in peripheral slidable engagement with the projections to define the protrusion of the vane from a vane groove is formed coaxially with the inner peripheral surface of the housing.

According to the present invention, the protrusion of the vane from the vane groove is not defined by the contact thereof with the inner peripheral surface of the housing, but it is defined in a manner such that the end edge of the vane depicts a certain locus by the engagement of the projections such as pins provided on the vane with the annular race formed on the side of the housing. The vane may be rotated in the state in which the vane is not in contact with the inner surface of the housing, and therefore, the present invention has excellent advantages which can prevent the deterioration of the efficiency of the pump caused by the sliding resistance and the wear of the vane; and which can prevent occurrence of inconvenience resulting from an increase in sliding heat.

The present invention further provides a vane pump comprising a rotor rotatably supported in eccentric fashion in an inner peripheral space of a housing, and plate-like vanes disposed capable of being projected and retracted into a plurality of vane grooves in the form of depressions in the rotor, wherein repeated variations in volumes of working spaces between the vanes resulting from rotations of the rotor and the vanes are utilized to suck a fluid from one side and discharge it toward the other, characterized in that retainers or bearings coaxial with the inner peripheral spaces are rotatably disposed internally of the end wall of the housing, and the retainers or bearings a engaged with the vanes to define the protrusion of the vanes from the vane grooves.

While the present invention has been briefly outlined, the above and other objects and new features of the present invention will be fully understood from the reading of the ensuing detailed description in conjunction with embodiments shown in the accompanying drawings. It is to be noted that the drawings are exclusively used to show certain embodiments for the understanding of the present invention and are not intended to limit the scope of this invention.

A fundamental exemplification of a vane pump according to the present invention will now be described with reference to FIGS. 1 to 3.

Figure 1:
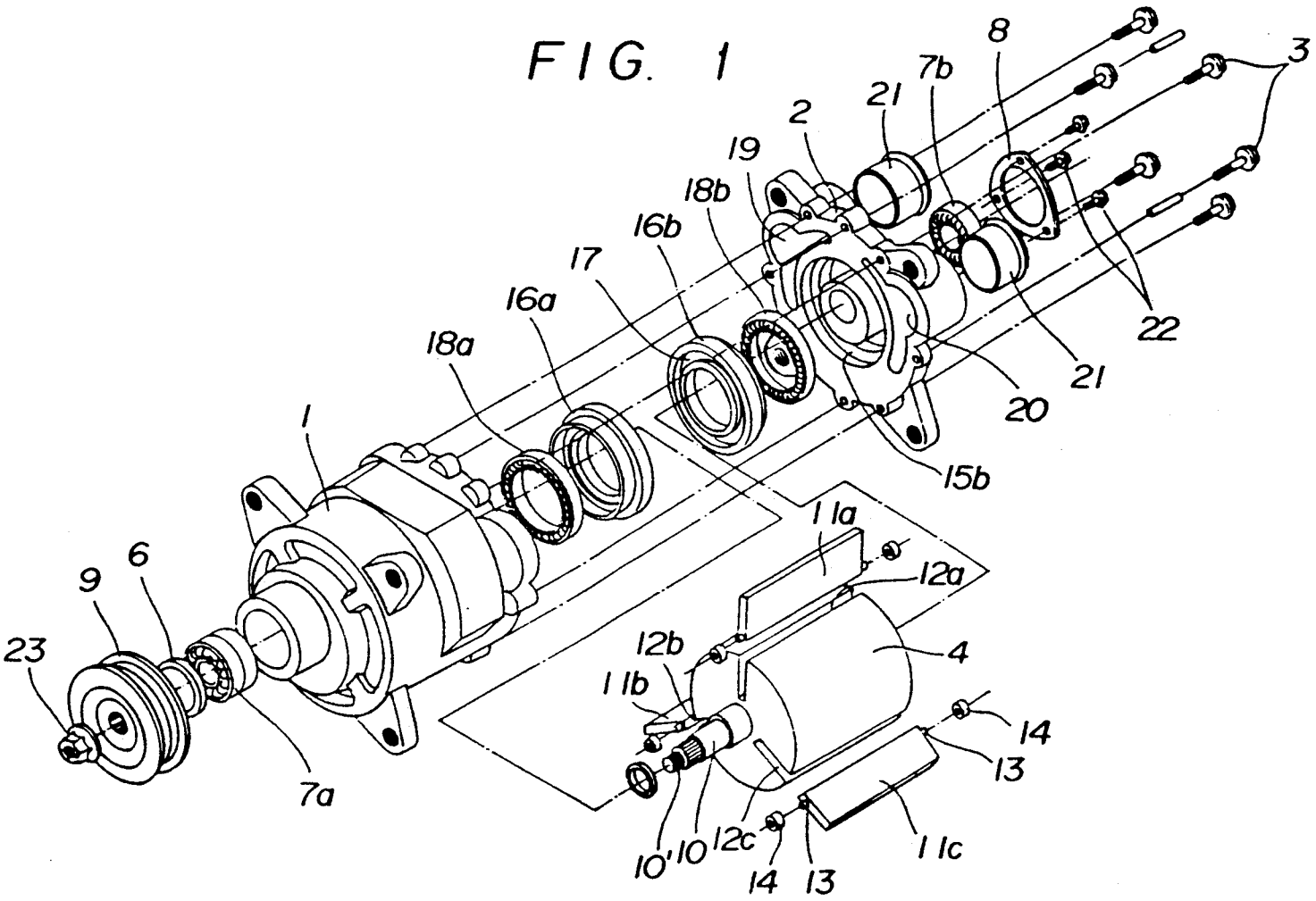
FIG. 1 is an exploded perspective view of a vane pump according to fundamental embodiment of the present invention.
Figure 2:
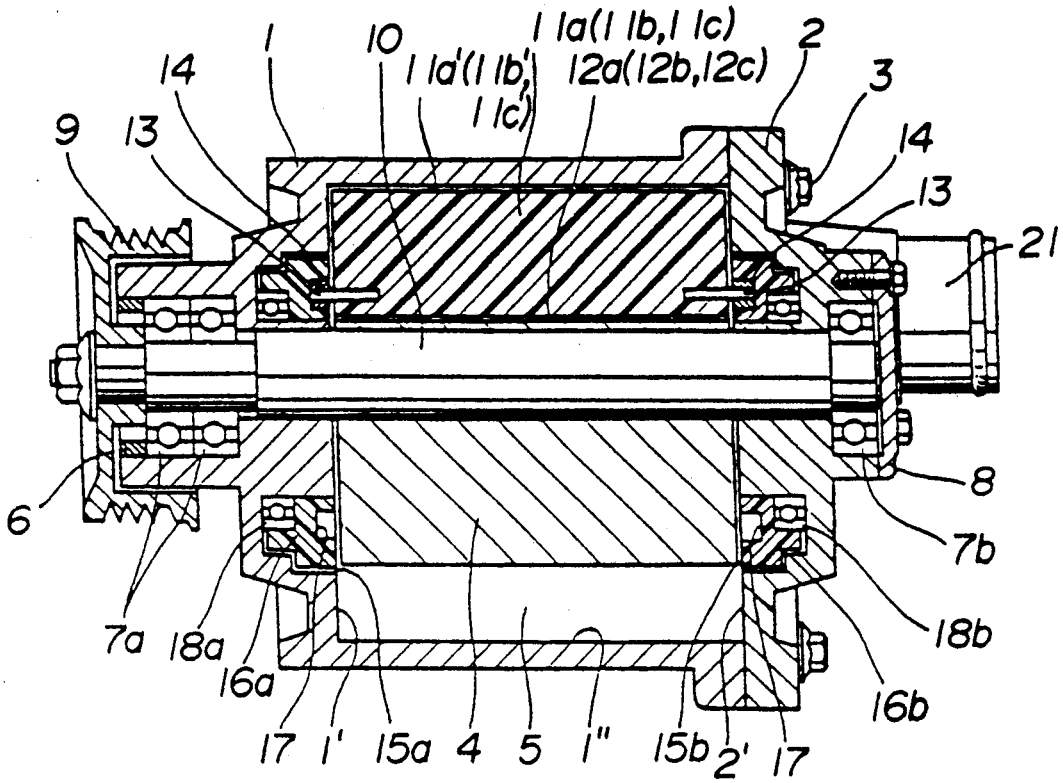
FIG. 2 is a sectional view showing the pump of FIG. 1 assembled.
Figure 3:
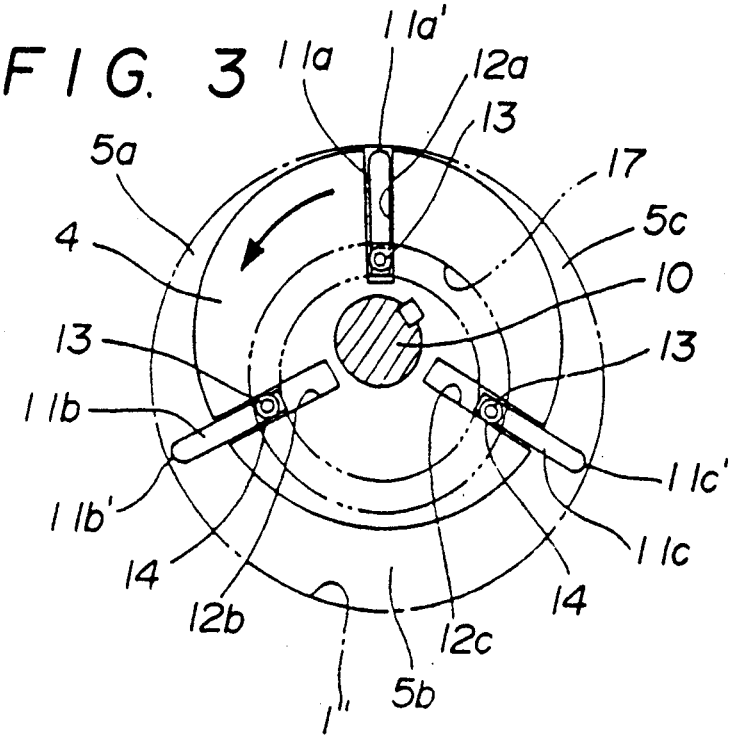
FIG. 3 is a side view of a rotor of the same pump of FIG. 1.
Figure 4:
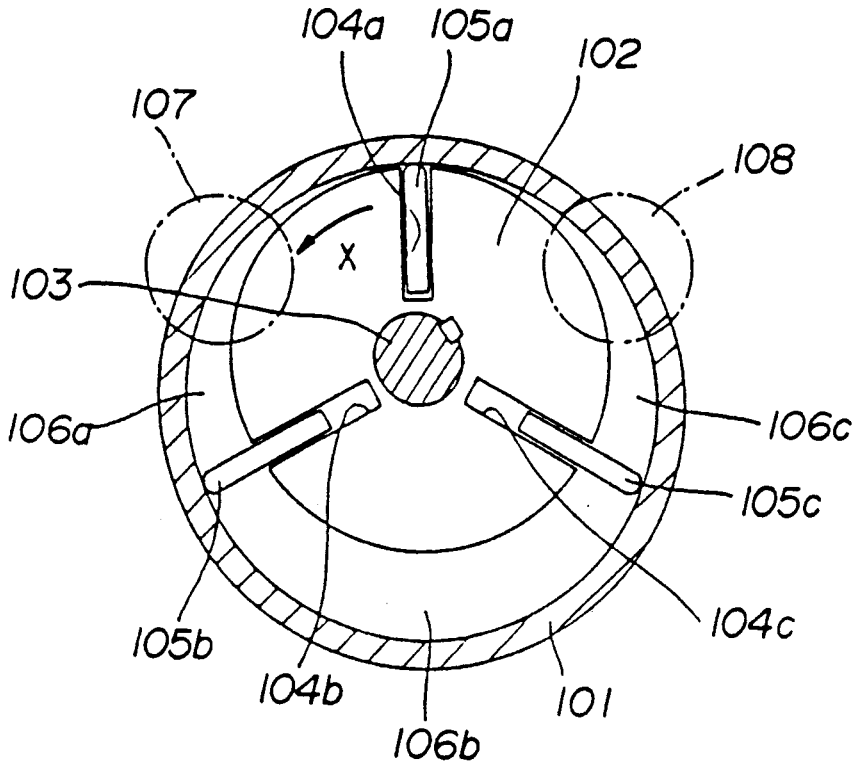
FIG. 4 PRIOR ART
FIG. 4 is a sectional view showing one example of a vane pump according to the prior art.

In FIGS. 1 and 2, a front housing 1 and a rear housing 2, both of which housings are made of non-ferrous metal such as aluminum, which is light in weight and is small in the coefficient of thermal expansion, are secured integral with each other by means of bolts 3. A rotor 4 made of iron eccentrically inserted into an inner peripheral space 5 of the housing is extended through both the housings 1 and 2 through a ball bearing 7*a* held by a fixed ring 6 in anti-slipout fashion in an axial shoulder of the front housing 1 and a ball bearing 7*b* held by a bearing cover 8 in anti-slipout fashion in an axial shoulder of the rear housing 2 and is rotatably mounted on a rotational shaft 10 to which a drive force is transmitted from a pulley 9. Plate-like vanes 11*a*, 11*b* and 11*c* principally made of a carbon material having an excellent slidability are disposed to be radially projected and retracted in vane grooves 12*a*, 12*b* and 12*c*, respectively, which are formed in the form of depressions equally spaced apart so as to peripherally divided the outer peripheral side of the rotor 4 into three sections, on the rotor 4. On opposite ends of each of the vanes 11*a*, 11*b* and 11*c* corresponding to axial opposite sides of the rotor 4 are projected steel pins 13 and 13, respectively, and a sleeve bearing 14 made of resin having excellent slidability and abrasion resistance is slipped over each of pins 13. In annular recesses 15*a* and 15*b* formed in inner surfaces 1' and 2' of end walls where the front housing 1 and the rear housing 2 are opposed to each other coaxial with the inner peripheral space 5 of the housing (coaxial with the inner peripheral surface 1'' of the front housing 1), retainer rings 16*a* and 16*b* made of non-ferrous metal such as aluminum and each having an annular race 17 are rotatably fitted through ball bearings 18*a* and 18*b*, respectively. The pins 13 and 13 projected on the respective vanes 11*a*, 11*b* and 11*c* peripherally slidably engage the annular races 17 and 17 of the retainer rings 16*a* and 16*b* through the respective sleeve bearings 14. This engagement defines the radial movement of the vanes 11*a*, 11*b* and 11*c* during rotation so as to maintain a state in which there is formed a slight clearance between the end edges 11*a'*, 11*b'* and 11*c'* (see FIG. 3) thereof and the inner peripheral surface 1'' of the front housing 1. An intake port 19 for guiding a fluid into the inner peripheral space 5 of the housing from the exterior of the pump and an outlet port 20 for guiding a fluid to the exterior from the inner peripheral space 5 of the housing are formed in the rear housing 2. Reference numerals 21, 21 designate tubes mounted on the intake port 19 and outlet port 20, respectively; 22 a bolt used to secure the bearing cover 8 to the rear housing 2; and 23, a nut in engagement with an external thread 10' of the end of the rotational shaft 10 in order to secure the pulley 9 to the rotational shaft 10.

The operation of the above-described vane pump will be described hereinafter. When the rotational shaft 10 and rotor 4 are rotated by the drive force from the pulley 9, the vanes 11*a*, 11*b* and 11*c* also rotate, and the pins 13 and 13 projected on the vanes 11*a*, 11*b* and 11*c*, respectively, and the sleeve bearings 14 and 14 slipped over the pins 13 and 13 rotate along the annular races 17 and 17. Since as shown in FIG. 3, the inner peripheral surface 1'' of the housing and the annular race 17 are in coaxial relation and the annular race 17 and the rotor 4 are in eccentric relation, the vanes 11*a*, 11*b* and 11*c* are radially slidably moved in the vane grooves 12*a*, 12*b* and 12*c* of the rotor 4 to be projected and retracted repeatedly with the result that the volumes of the working spaces 5*a*, 5*b* and 5*c* defined by both the housings 1, 2, the rotor 4 and the vanes 11*a*, 11*b* and 11*c* repeatedly increase and decrease. That is, in FIG. 3, the working space 5*a* with the rotation, increases its volume to suck the fluid from the intake port 19 (not shown; see FIG. 1) opening to portion 5*a*; the working space 5*c*, with the rotation, decreases its volume to discharge the fluid into the outlet port 20 (not shown; see FIG. 1) opening to portion 5*c*; and the working space 5*b* transfers the thus sucked fluid toward the outlet port 20. In the above-described operation, the end edges 11*a'*, 11*b'* and 11*c'* of the vanes 11*a*, 11*b* and 11*c* are not in sliding contact with the inner peripheral surface 1'' of the front housing, as previously mentioned, and therefore, abrasion or high heat hardly occurs. In addition, the sleeve bearing 14 slipped over the pin 13 is slidably rotated while being pressed against the outside diameter side by the centrifugal force within the annular race 17 of the retainer rings 16*a* and 16*b* while the retainer rings 16*a* and 16*b* follow the sleeve bearing 14 for rotation because the former are in the state to be rotatable by the ball bearings 18*a* 18*b*, respectively. The relative sliding speed between the sleeve bearing 14 and the annular race 17 is low whereby the abrasions of annular race 17, retainer rings 16*a* and 16*b*, the sleeve bearing 14 and the like can be minimized.

While we have described the preferred embodiment of the present invention, it will be obvious that various other modifications can be made without departing from the principle of the present invention. Accordingly, it is desired that all the modifications that may substantially obtain the effect of the present invention through the use of the structure substantially identical with or corresponding to the present invention are included in the scope of the present invention.

This application incorporates herein the disclosures of U.S Ser. Ser. Nos. 075,006, filed Jul. 17, 1987; 110,919 filed Oct. 21, 1987; 113,568 filed Oct. 26, 1987; 115,677 filed Oct. 30, 1987.

What we claim is:

1. A vane pump comprising a housing having a rotor chamber, said rotor chamber having longitudinal end walls and an inner annular surface, a rotor means rotatably mounted in said rotor chamber, said inner annular surface having a chamber axis which is eccentric relative to the axis of rotation of said rotor means, said rotor member end walls being perpendicular to said axis of rotation, said rotor means having a plurality of generally radially disposed vane slots, a plurality of vane means slidably mounted in said vane slots and operable to define variable volume chambers for effecting a pumping action as said rotor means rotates and said vane means move generally radially in and out of said vane slots, said vane means each having an outer radial end and longitudinal axial ends, projections means projecting from said longitudinal ends, said housing having an annular channel coaxial with said chamber axis, said channel having spaced inner and outer peripheral walls formed by said housing an extending from said rotor chamber end wall, annular ring means disposed in said channel, bearing means rotatable within said channel rotatably supportin said ring means within said channel, said bearing means being spaced from said outer peripheral wall of said channel, said ring means having an uninterrupted annular groove coaxial with said chamber axis, said groove having a continuous uninterrupted inner cylindrical surface disposed to be engaged by said projection means such that during rotation of said rotor means, the resulting centrifugal force urges said vane means radially outwardly of the respective vane slot such that said projection means engages and presses against said inner cylindrical surface to effect rotation of said ring means, said inner cylindrical surface being disposed to limit the extent of outward radial movement of said vane means from its respective vane slot to provide a space between said outer radial ends of said vane means and said inner annular surface of said housing, thereby precluding sliding contact between said outer radial ends of said vane means and said inner annular surface as said rotor means rotates within said housing.

2. A vane pump according to claim 1, wherein said channel further comprises a bottom wall defining the bottom end of said channel, said bottom wall extending between said inner and outer peripheral walls, said bottom wall means being formed by said housing.

3. A vane pump comprising a housing having a rotor chamber, said rotor chamber having longitudinal end walls and an inner annular surface, a rotor means rotatably mounted in said rotor chamber, said inner annular surface having a chamber axis which is eccentric relative to the axis of rotation of said rotor means, said rotor chamber end walls being perpendicular to said axis of rotation, said rotor means having a plurality of generally radially disposed vane slots, a plurality of vane means slidably mounted in said vane slots and operable to define variable volume chambers for effecting a pumping action as said rotor means rotates and said vane means move generally radially in and out of said vane slots, said vane means having longitudinal ends, projection means projecting from said longitudinal ends, said rotor chamber end walls having an annular channel coaxial with said chamber axis, said channel having inner wall means and outer wall means formed by said housing, said inner wall means being spaced radially inwardly of said outer wall means, said inner and outer wall means each extending to said rotor chamber end wall, annular ring means disposed in said channel, bearing means rotatable within said channel rotatably supporting said ring means within said channel, said bearing means being spaced from said outer wall means of said channel, said ring means having an uninterrupted annular groove coaxial with said chamber axis, said groove having an inner cylindrical surface disposed to be engaged by said projection means such that during rotation of said rotor means, the resulting centrifugal force urges said vane means radially outwardly of the respective vane slot such that said projection means engages said inner cylindrical surface, said inner cylindrical surface being disposed to limit the extent of outward radial movement of said vane means from its respective vane slot to preclude sliding contact between said vane means and said inner annular surface of said housing.

* * * * *